US011271286B2

(12) United States Patent
Liu et al.

(10) Patent No.: US 11,271,286 B2
(45) Date of Patent: Mar. 8, 2022

(54) METAL SHIELDING COVER SLOT ANTENNA AND ELECTRONIC DEVICE

(71) Applicant: ESPRESSIF SYSTEMS (SHANGHAI) CO., LTD., Pudong New Area Shanghai (CN)

(72) Inventors: Fei Liu, Pudong New Area Shanghai (CN); Swee Ann Teo, Pudong New Area Shanghai (CN)

(73) Assignee: ESPRESSIF SYSTEMS (SHANGHAI) CO., LTD., Pudong New Area Shangha (CN)

( * ) Notice: Subject to any disclaimer, the term of this patent is extended or adjusted under 35 U.S.C. 154(b) by 0 days.

(21) Appl. No.: 16/630,560

(22) PCT Filed: Aug. 15, 2018

(86) PCT No.: PCT/CN2018/100671
§ 371 (c)(1),
(2) Date: Jan. 13, 2020

(87) PCT Pub. No.: WO2019/034085
PCT Pub. Date: Feb. 21, 2019

(65) Prior Publication Data

US 2021/0091455 A1 Mar. 25, 2021

(30) Foreign Application Priority Data

Aug. 15, 2017 (CN) ..... 201710697038.2

(51) Int. Cl.
*H01Q 1/38* (2006.01)
*H01Q 1/24* (2006.01)
(Continued)

(52) U.S. Cl.
CPC ..... *H01Q 1/243* (2013.01); *H01Q 1/38* (2013.01); *H01Q 13/10* (2013.01); *H01Q 21/28* (2013.01)

(58) Field of Classification Search
CPC ..... H01G 1/243; H01G 1/38; H01G 13/10; H01G 21/28
See application file for complete search history.

(56) References Cited

U.S. PATENT DOCUMENTS 6,573,869 B2 * 6/2003 Moore ..... H01Q 1/243 343/700 MS
2012/0157175 A1 6/2012 Golko et al.

FOREIGN PATENT DOCUMENTS

CN 104505574 A 4/2015
CN 104518280 A 4/2015
(Continued)

OTHER PUBLICATIONS

PCT/CN2018/100671, International Search Report dated Nov. 1, 2018.

*Primary Examiner* — Graham P Smith
(74) *Attorney, Agent, or Firm* — Meunier Carlin & Curfman LLC

(57) ABSTRACT

Disclosed is a metal shielding cover slot antenna, which includes a metal shielding cover. The metal shielding cover includes a plurality of conductive surfaces, and the metal shielding cover further includes: a slot, an antenna feed terminal and an antenna ground portion. The slot is disposed in at least one of the plurality of conductive surfaces of the metal shielding cover; the antenna ground portion is formed by at least one of the plurality of conductive surfaces, formed by a cut in at least one of the plurality of conductive surfaces or connected to at least one of the plurality of conductive surfaces; the antenna feed terminal is formed by a cut in at least one of the plurality of conductive surfaces
(Continued)

or connected to at least one of the plurality of conductive surfaces; and a conductive path starts from the antenna feed terminal and extends along the slot. Also disclosed is an electronic device.

15 Claims, 12 Drawing Sheets

(51) Int. Cl.
*H01Q 13/10* (2006.01)
*H01Q 21/28* (2006.01)

(56) References Cited

FOREIGN PATENT DOCUMENTS

| | | | |
|---|---|---|---|
| CN | 105071038 | A | 11/2015 |
| CN | 107394392 | A | 11/2017 |
| CN | 207282717 | U | 4/2018 |

* cited by examiner

METAL SHIELDING COVER SLOT ANTENNA AND ELECTRONIC DEVICE

CROSS-REFERENCE TO RELATED APPLICATIONS

This application is a US national phase application of international patent application No. PCT/CN2018/100671 filed on Aug. 15, 2018, which claims priority to Chinese patent application No. 201710697038.2 filed on Aug. 15, 2017, the disclosures of each of which are fully incorporated herein by reference in their entireties.

TECHNICAL FIELD

The present disclosure relates to the field of wireless communication, for example, to a metal shielding cover slot antenna and an electronic device.

BACKGROUND

In recent years, with the rapid development and application of multiple electronic communication devices (for example, internet of things technology) and the popularization of intelligent terminals, a requirement for integration level of a system is also higher and higher. Based on the limitation of application scenarios, a requirement that a system is small enough in volume and convenient to be integrated in multiple applications such as a portable sound box, a lamp and a switches exists, so that the volume of an internet of things system is a factor restricting the further development of the internet of things, and a problem how to make an antenna small enough and be convenient for installation exists.

At present, the performance of an antenna commercially applied is related to the internet of things system, the antenna needs to be debugged and matched differently for different operating environments, and requirements for the performance, the volume, the appearance, the installation convenience and the like of the antenna are higher and higher. Therefore, how to provide a miniaturized antenna which fully utilizes space and has performance satisfying basic requirements, and how to improve the integration level and application of the internet of things system becomes a problem to be solved urgently in the field of the internet of things.

SUMMARY

A metal shielding cover slot antenna and an electronic device are provided according to the present disclosure. In this electronic device, a miniaturized antenna which can fully utilize space and satisfy requirements is used for solving the problem in which the volume of an internet of things system restricts the integration and application of the internet of things system, and for overcoming the problem of layout waste and cost increase when a traditional internet of things chip in wireless communication uses an on-board antenna or a planar inverted-F antenna (PIFA).

A metal shielding cover slot antenna is provided according to the present disclosure. The metal shielding cover slot antenna includes a metal shielding cover.

The metal shielding cover includes a plurality of conductive surfaces.

The metal shielding cover further includes: a slot, an antenna feed terminal and an antenna ground portion.

The slot is disposed in at least one of the plurality of conductive surfaces of the metal shielding cover.

The antenna ground portion is formed by at least one of the plurality of conductive surfaces, formed by a cut in at least one of the plurality of conductive surfaces or connected to at least one of the plurality of conductive surfaces.

The antenna feed terminal is formed by a cut in at least one of the plurality of conductive surfaces or connected to at least one of the plurality of conductive surfaces.

A conductive path starting from the antenna feed terminal and extending along the slot is formed.

In one embodiment, the antenna ground portion is configured to be connected to a ground plane.

The antenna feed terminal is configured to be connected to a radio-frequency transceiver circuit.

The metal shielding cover is configured to at least overlap the radio-frequency transceiver circuit in a vertical direction.

In one embodiment, the metal shielding cover may be a cube, a cylinder or an irregular three-dimensional structure.

In one embodiment, the conductive path is configured in one of the manners described below.

The conductive path is positioned in a two-dimensional conductive plane. The two-dimensional conductive plane is any one of the plurality of conductive surfaces of the metal shielding cover or a plane in which any one of the plurality of conductive surfaces is positioned.

The conductive path is positioned in a three-dimensional conductive structure. The three-dimensional conductive structure is formed by the plurality of conductive surfaces of the metal shielding cover.

The conductive path is positioned in a three-dimensional conductive structure. The three-dimensional conductive structure is formed by a plane in which the antenna feed terminal is positioned and the plurality of conductive surfaces of the metal shielding cover. The plane in which the antenna feed terminal is positioned is not any one of the plurality of conductive surfaces of the metal shielding cover.

In one embodiment, the metal shielding cover slot antenna further includes an antenna support point.

The antenna support point is formed by a cut in at least one of the plurality of conductive surfaces of the metal shielding cover, or the antenna support point is connected to at least one of the plurality of conductive surfaces of the metal shielding cover.

In one embodiment, the antenna feed terminal and the antenna support point are configured in one of the manners described below.

The antenna feed terminal and the antenna support point are positioned in a same one of the plurality of conductive surfaces of the metal shielding cover.

The antenna feed terminal and the antenna support point are positioned in different ones of the plurality of conductive surfaces of the metal shielding cover.

One of the antenna feed terminal and the antenna support point is positioned in any one of the plurality of conductive surfaces of the metal shielding cover or a plane in which any one of the plurality of conductive surfaces is positioned, and the other one of the antenna feed terminal or the antenna support point is disposed inside a surrounding structure formed by the plurality of conductive surfaces of the metal shielding cover and is connected to any one or more of the plurality of conductive surfaces of the metal shielding cover.

Both the antenna feed terminal and the antenna support point are disposed inside a surrounding structure formed by the plurality of conductive surfaces of the metal shielding cover, and connected to a same one of the plurality of conductive surfaces of the metal shielding cover or connected to different ones of the plurality of conductive surfaces of the metal shielding cover.

In one embodiment, the slot is formed in a top surface of the metal shielding cover; and the peripheral shape of the slot includes one of a strip, a rectangle, a circle, an ellipse or a polygon.

In one embodiment, the antenna feed terminal is formed by a cut in any vertical conductive surface of the metal shielding cover vertical to the top surface, or the antenna feed terminal is a thin-sheet metal structure connected to the inner side of the top surface.

The antenna support point is formed by a cut in any vertical conductive surface of the metal shielding cover vertical to the top surface, or the antenna support point is a thin-sheet metal structure connected to the inner side of the top surface.

In one embodiment, when the antenna ground portion is formed by at least one of the plurality of conductive surfaces, the antenna ground portion is formed by all or part of conductive surfaces of the metal shielding cover excluding a conductive surface in which the slot is positioned, a position of the antenna feed terminal and a position of the antenna support point.

In one embodiment, the antenna feed terminal is spaced apart from the antenna ground portion through a gap.

The antenna feed terminal is spaced apart from the antenna support point through a conductive surface and a gap, or the antenna feed terminal is spaced apart from the antenna support point through a gap.

In one embodiment, the radio-frequency transceiver circuit is disposed on a printed circuit board; and the antenna ground portion is welded to the printed circuit board, or the metal shielding cover slot antenna is secured to the printed circuit board by using but not limited to using a device, such as a shielding cover clamp or the like.

In one embodiment, the printed circuit board is provided with a feed pad, a support point pad and an antenna ground pad.

The antenna feed terminal is configured to be connected to the feed pad. The radio-frequency transceiver circuit is configured to be connected to the feed pad through a transmission wire.

The antenna support point is configured to be connected to the support point pad. The antenna ground portion is configured to be connected to the antenna ground pad.

An electronic device is further provided according to the present disclosure. The electronic device includes a wireless communication system. The wireless communication system includes the metal shielding cover slot antenna as described above and a radio-frequency transceiver circuit communicatively connected to the metal shielding cover slot antenna. Part of the metal shielding cover slot antenna is further connected to a ground plane disposed in the wireless communication system.

In one embodiment, the ground plane is provided with a ground reference portion and the metal shielding cover slot antenna is at least partially connected to the ground reference portion.

In one embodiment, the wireless communication system further includes a transmission wire and the transmission configured to transmit a signal.

In one embodiment, the wireless communication system further includes an antenna matching circuit, and the antenna matching circuit is disposed between the radio-frequency transceiver circuit and the feed pad and is connected to the radio-frequency transceiver circuit and the feed pad through transmission wires; and the metal shielding cover slot antenna at least overlaps the antenna matching circuit in the vertical direction.

In one embodiment, the radio-frequency transceiver circuit includes a radio-frequency transceiver operating in one or more radio-frequency communication bands; and the radio-frequency communication bands include a wireless fidelity (Wi-Fi) band at 2.4 GHz, a Wi-Fi band at 5 GHz or a bluetooth communication band at 2.4 GHz.

A metal shielding cover slot antenna and an electronic device are provided according to the present disclosure. The metal shielding cover slot antenna can ensure good communication performance while fully utilizing the inner space of the electronic device, and effectively reduce the volume and cost of a wireless communication module; the metal shielding cover slot antenna can further be applied to some wearable wireless communication devices to save the layout space of a local wireless communication circuit while satisfying basic performance requirements, thereby better satisfying requirements in different applications.

1. printed circuit board; 2. metal shielding cover slot antenna; 3. antenna matching circuit; 3*a*. first element; 3*b*. second element; 3*c*. third element; 4. radio-frequency transceiver circuit; 5. electronic device; 6. storage and processing circuit; 7. wireless communication system; 8. metal shielding cover; 9. slot; 9*a*. antenna ground portion; 10. a first surface of the antenna ground portion; 11. a second surface of the antenna ground portion; 12. a third surface of the antenna ground portion; 13. a fourth surface of the antenna ground portion; 10*a*. first ground pad; 11*a*. second ground pad; 12*a*. third ground pad; 13*a*. fourth ground pad; 14*a*. support point pad; 14. antenna support point; 15. antenna feed terminal; 15*a*. feed pad; 16. cut gap; 17. antenna feed terminal; 18. cut gap; 19. a fourth surface of the antenna ground portion; 20. a second surface of the antenna ground portion; 21. a third surface of the antenna ground portion; 22. a first surface of the antenna ground portion; 22*a*. antenna ground portion; 23. antenna support point; 24. metal shielding cover; 25. slot; 271. first transmission wire; 272. second transmission wire; 273. third transmission wire; 28. antenna support point; 29. antenna feed terminal; 30. antenna support point; 31. antenna feed terminal; 32. slot; 33. metal shielding cover; 34. cut gap; 35. metal shielding cover; 35-1. straight line at the edge of the opening; 36. slot; 37. a fourth surface of the antenna ground portion; 38. a second surface of the antenna ground portion; 39. a third surface of the antenna ground portion; 40. a first surface of the antenna ground portion; 40*a*. antenna ground portion; 41. second antenna ground portion; 41*a*. antenna ground portion

DETAILED DESCRIPTION

A metal shielding cover slot antenna and an electronic device are provided according to the present disclosure. The following describes the present disclosure in conjunction with the drawings and the embodiments, but is not intended to limit the present disclosure.

Figure 1:
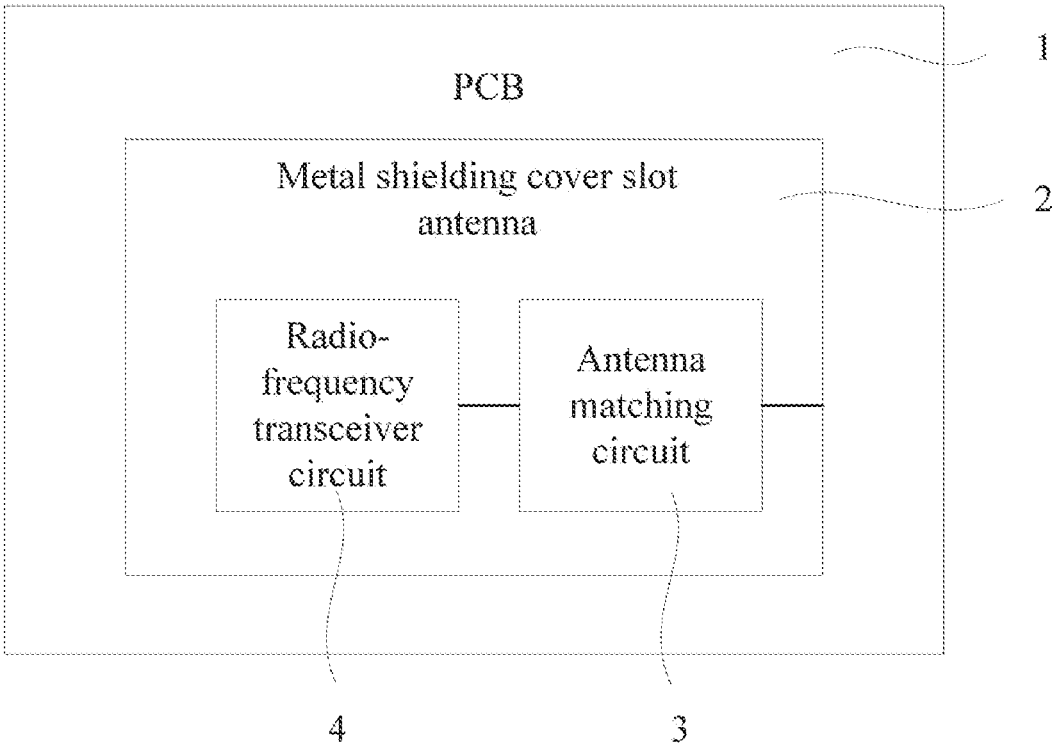
FIG. 1 is a schematic layout view including a radio-frequency transceiver circuit and a metal shielding cover slot antenna according to embodiment one.
Figure 2:
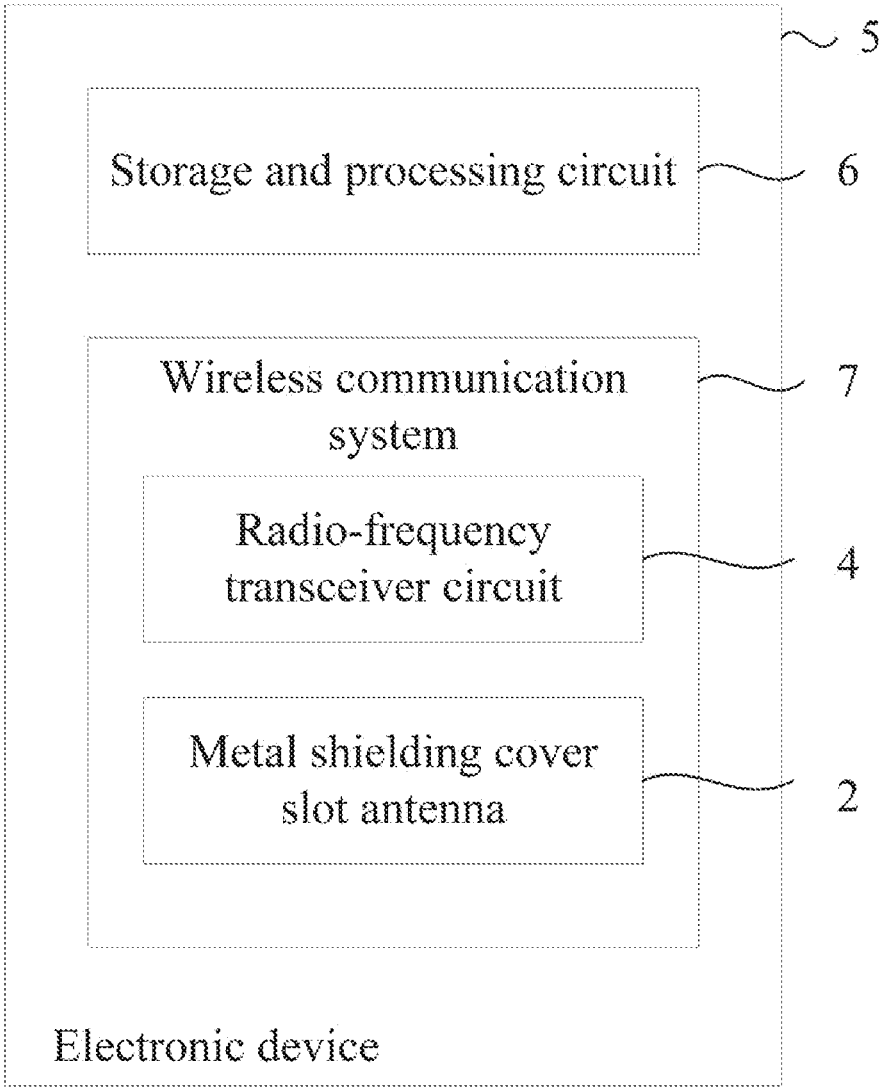
FIG. 2 is a schematic view of an electronic device according to embodiment one.

An electronic device 5 provided according to the present disclosure includes a wireless communication system 7 and a storage and processing circuit 6. As shown in FIG. 1 and FIG. 2, the wireless communication system 7 includes a metal shielding cover slot antenna 2, and a radio-frequency transceiver circuit 4 based on short-range and long-range wireless communication. The wireless communication system 7 may further include a transmission wire for transmitting a signal. The transmission wire is connected to the radio-frequency transceiver circuit 4, an antenna matching circuit 3 and the metal shielding cover slot antenna 2.

As shown in FIG. 1, the radio-frequency transceiver circuit 4 and the antenna matching circuit 3 are disposed on a printed circuit board (PCB) 1, the metal shielding cover slot antenna 2 at least partially covers the radio-frequency transceiver circuit 4 and the antenna matching circuit 3 in a vertical direction, and the metal shielding cover slot antenna 2 is connected to the printed circuit board 1. The antenna matching circuit 3 is designed as required. The radio-frequency transceiver circuit 4 may operate in Wi-Fi (Institute of Electrical and Electronics Engineers (IEEE) 802.11) bands at 2.4 GHz and 5 GHz and a bluetooth communication band at 2.4 GHz, but the radio-frequency transceiver circuit 4 is not limited to operating in the above-mentioned communication bands.

Embodiment One

Figure 4A:
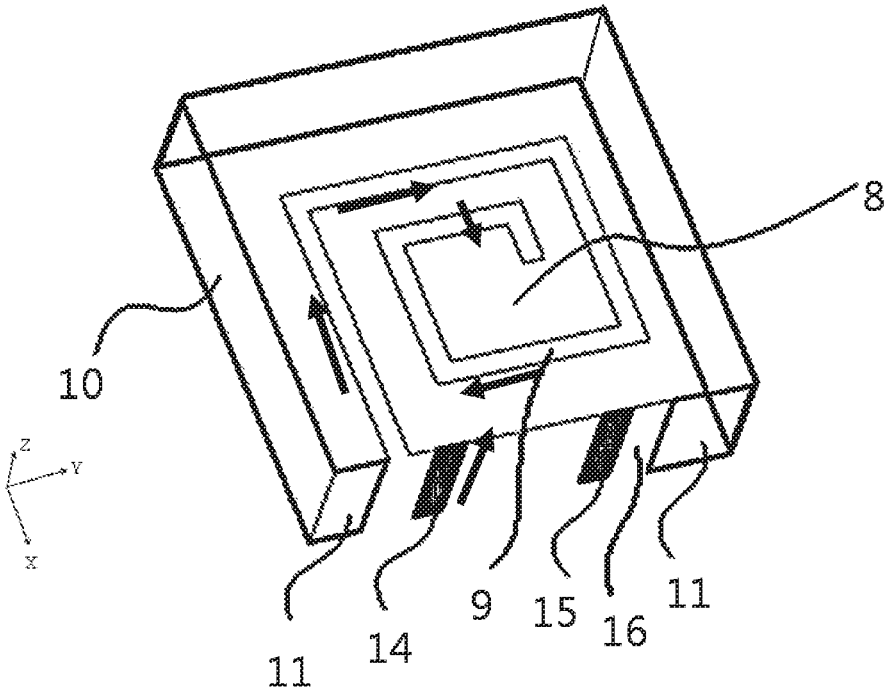
FIG. 4*a* is a schematic front view of a metal shielding cover slot antenna according to embodiment one.

As shown in FIG. 4*a*, the metal shielding cover slot antenna 2 includes a metal shielding cover 8, each surface of the metal shielding cover 8 is a conductive surface, and the metal shielding cover 8 includes a slot 9, an antenna feed terminal 15, an antenna support point 14 and an antenna ground portion 9*a*. The metal shielding cover 8 may be a cube, a cylinder or an irregular three-dimensional structure.

Figure 3:
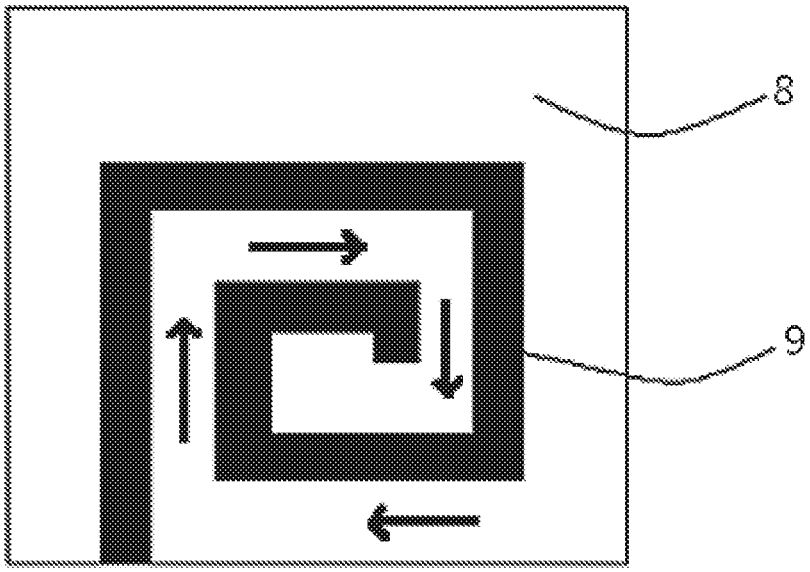
FIG. 3 is a schematic view of a slot of a metal shielding cover slot antenna according to embodiment one.

As shown in FIG. 3, a top surface of the metal shielding cover 8 is slotted so that a slot 9 is formed, and thereby an effective conductive path can be obtained to radiate a microwave signal. The arrows in FIG. 3 and FIG. 4*a* indicate the direction of the effective conductive path, that is, the effective conductive path starts from the antenna feed terminal 15 and extends along the peripheral structure of the slot 9. The peripheral shape of the slot 9 may be a strip, a rectangle, a circle, an ellipse or another polygon.

The shape, width and length of the slot 9 can be adjusted to satisfy actual radiation efficiency and directivity requirements of the metal shielding cover slot antenna 2.

Figure 5:
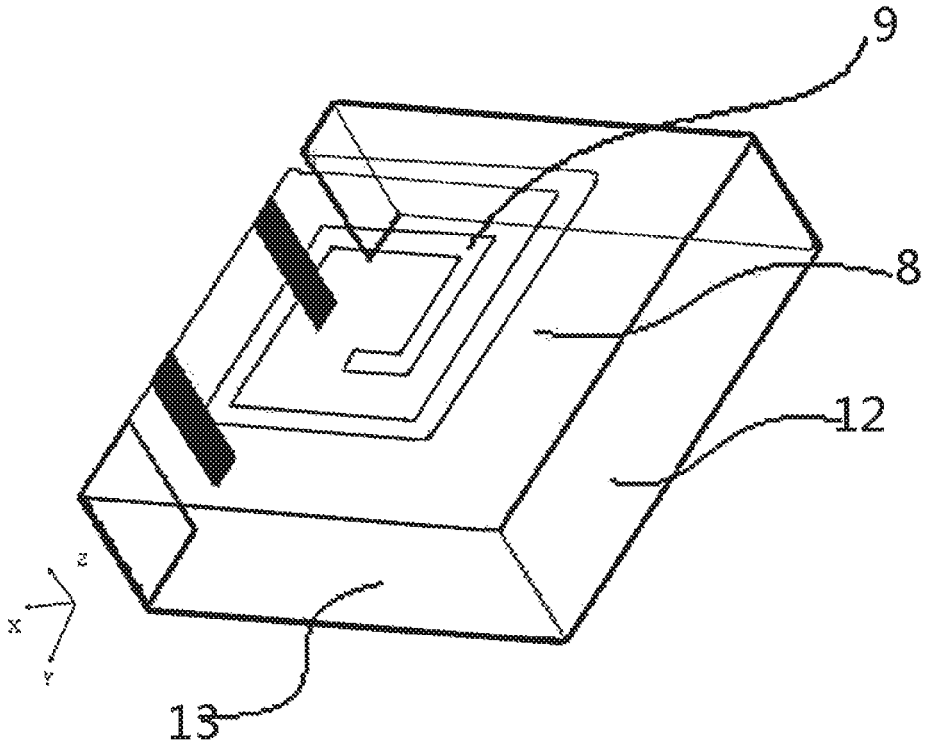
FIG. 5 is a schematic rear view of a metal shielding cover slot antenna according to embodiment one.
Figure 7:
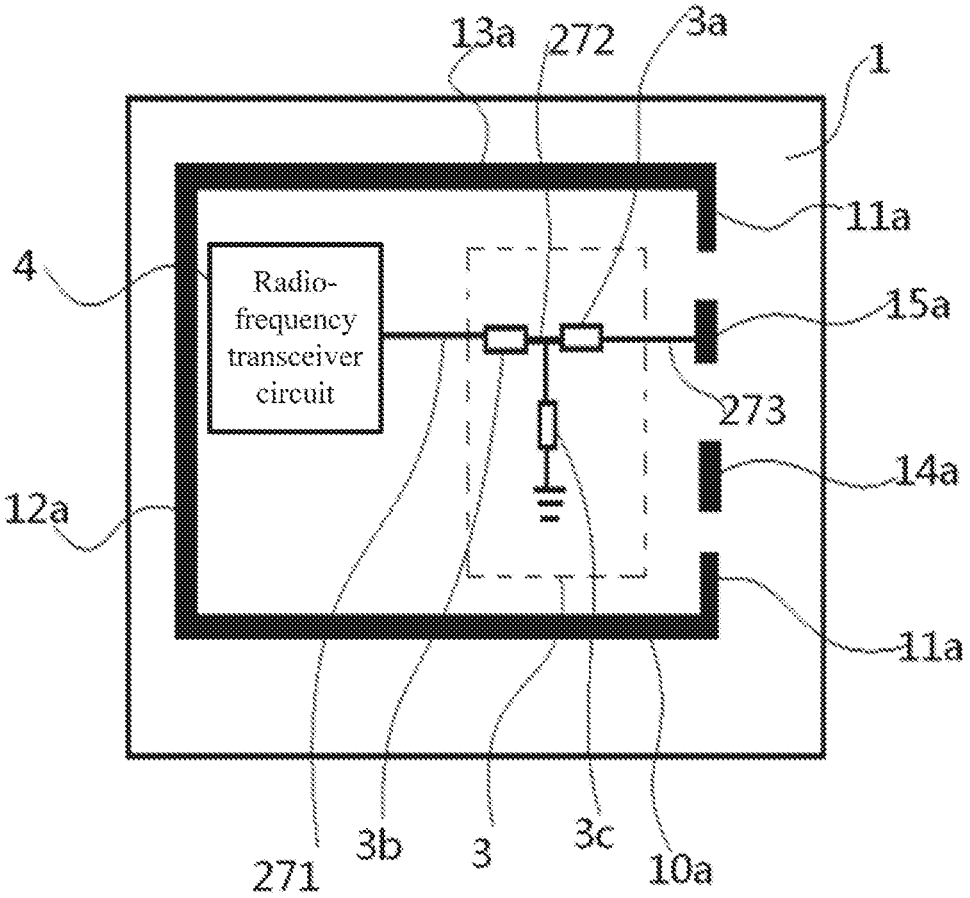
FIG. 7 is a schematic top view of a radio-frequency transceiver circuit and a metal shielding cover slot antenna according to embodiment one.

The antenna feed terminal 15 and the antenna support point 14 may be formed through a cut in any conductive surface of the metal shielding cover 8. As shown in FIG. 4*a*, FIG. 5 and FIG. 7, in this embodiment, one vertical conductive surface (the vertical conductive surface is perpendicular to the top surface of the metal shielding cover 8) of the metal shielding cover 8 is cut, so that the antenna feed terminal 15 and the antenna support point 14 are formed. One end of the antenna feed terminal 15 is connected to the edge of the top surface, and the other end of the antenna feed terminal 15 is welded to a feed pad 15*a* on a printed circuit board 1. One end of the antenna support point 14 is connected to the edge of the top surface, and the other end of the antenna support point 14 is welded to a support point pad 14*a* on the printed circuit board 1.

Figure 4B:
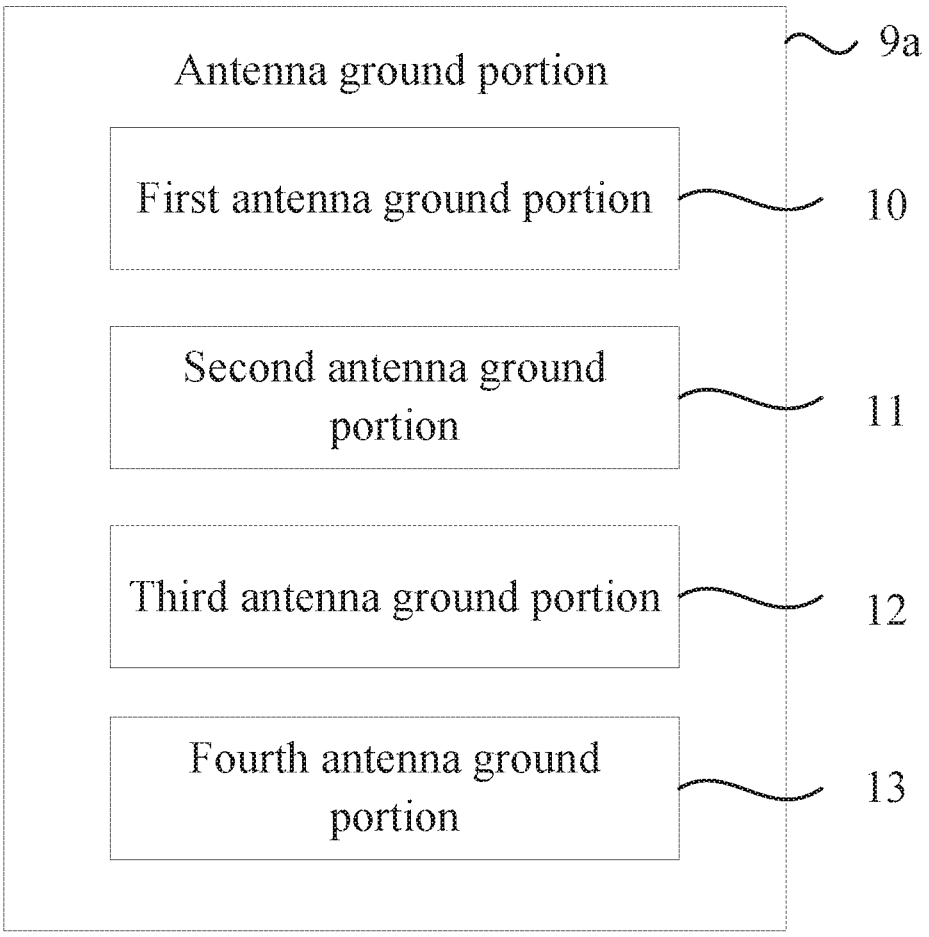
FIG. 4*b* is a schematic view of an antenna ground portion according to embodiment one.

The antenna ground portion 9*a* is formed in at least part of conductive surfaces of the metal shielding cover 8 excluding the top surface in which the slot 9 is positioned, the antenna feed terminal 15 and the antenna support point 14. In one embodiment, as shown in FIG. 4*b*, the antenna ground portion 9*a* includes a first surface of the antenna ground portion 10, a second surface of the antenna ground portion 11, a third surface of the antenna ground portion 12 and a fourth surface of the antenna ground portion 13, and each antenna ground portion is formed in a respective one of the four vertical conductive surfaces.

The printed circuit board 1 is provided with a first ground pad 10*a*, a second ground pad 11*a*, a third ground pad 12*a* and a fourth ground pad 13*a*. The first surface of the antenna ground portion 10 is welded to the first ground pad 10*a*, the second surface of the antenna ground portion 11 is welded to the second ground pad 11*a*, the third surface of the antenna ground portion 12 is welded to the third ground pad 12*a*, and the fourth surface of the antenna ground portion 13 is welded to the fourth ground pad 13*a*.

As shown in FIG. 4*a*, the antenna support point 14 and the antenna feed terminal 15 are positioned in the same vertical conductive surface, and a cut gap 16 is formed by a cut in the vertical conductive surface in which the antenna feed terminal 15 is positioned, so that a space is formed between the antenna feed terminal 15 and the second surface of the antenna ground portion 11. Through adjustments to the width of the antenna feed terminal 15 and the size of the cut gap 16, the antenna impedance and the communication band bandwidth of the metal shielding cover slot antenna 2 can be adjusted and optimized.

In one embodiment, according to the shape of slot 9, the antenna support point 14 is disposed as required, and the antenna support point 14 may be positioned in the surface of the metal shielding cover 8, be separately disposed inside the metal shielding cover slot antenna 2 or may not be disposed in some implementations and applications.

As shown in FIG. 7, the radio-frequency transceiver circuit 4 is connected to the antenna matching circuit 3 through a first transmission wire 271, the antenna matching circuit 3 is connected to the feed pad 15*a* through a third transmission wire 273, and the antenna feed terminal is welded to the feed pad 15*a* on the printed circuit board 1, so that the radio-frequency transceiver circuit 4 is connected to the antenna feed terminal.

The antenna matching circuit 3 includes a second transmission wire 272, a first element 3*a*, a second element 3*b* and a third element 3*c*. The second transmission wire 272 is disposed between the first element 3*a* and the second element 3*b*. The third element 3*c* is connected to the second transmission wire 272, and meanwhile, the third element 3*c* is grounded. The first element 3*a*, the second element 3*b* and the third element 3*c* in the antenna matching circuit 3 may be passive elements such as inductors, capacitors and resistors.

The dotted line in FIG. 7 indicates the inner structure of the antenna matching circuit 3 of embodiment one, and the inner structure is T-type. However, the antenna matching circuit 3 is not limited to T-type, and may be of multiple reasonable structures, for example, PI-type. The number of the electronic elements used for matching is not limited to three shown in embodiment one, and the antenna matching circuit 3 may be composed of other numbers of electronic elements.

The antenna matching circuit 3 is not essential, and in some implementations and applications, the radio-frequency transceiver circuit 4 disposed on the printed circuit board 1 may be directly connected to the antenna feed pad 15*a* through a transmission wire, so that the radio-frequency transceiver circuit 4 is connected to the antenna feed terminal to perform signal transceiver.

Figure 6:
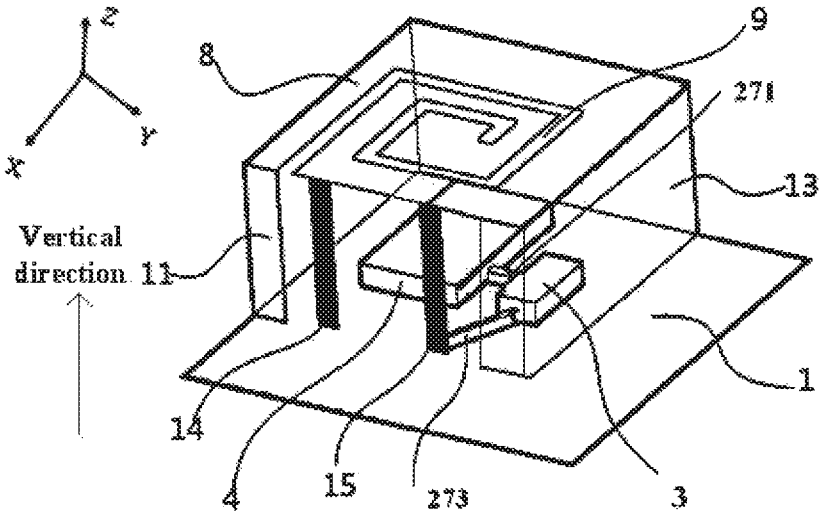
FIG. 6 is a front perspective view of a metal shielding cover slot antenna according to embodiment one.

As shown in FIG. 6, the metal shielding cover slot antenna 2 at least overlaps the antenna matching circuit 3 in the vertical direction, and the metal shielding cover slot antenna 2 at least overlaps the radio-frequency transceiver circuit 4 in the vertical direction.

The metal shielding cover slot antenna 2 may completely cover the radio-frequency transceiver circuit 4 and the antenna matching circuit 3, and this reduces the value of the specific absorption rate (SAR) of electromagnetic radiation while achieving wireless communication. Therefore, the metal shielding cover slot antenna 2 can be applied to wearable wireless communication devices to save the layout space of a local wireless communication circuit while satisfying basic performance requirements, thereby better satisfying requirements in different applications.

Embodiment Two

Figure 8A:
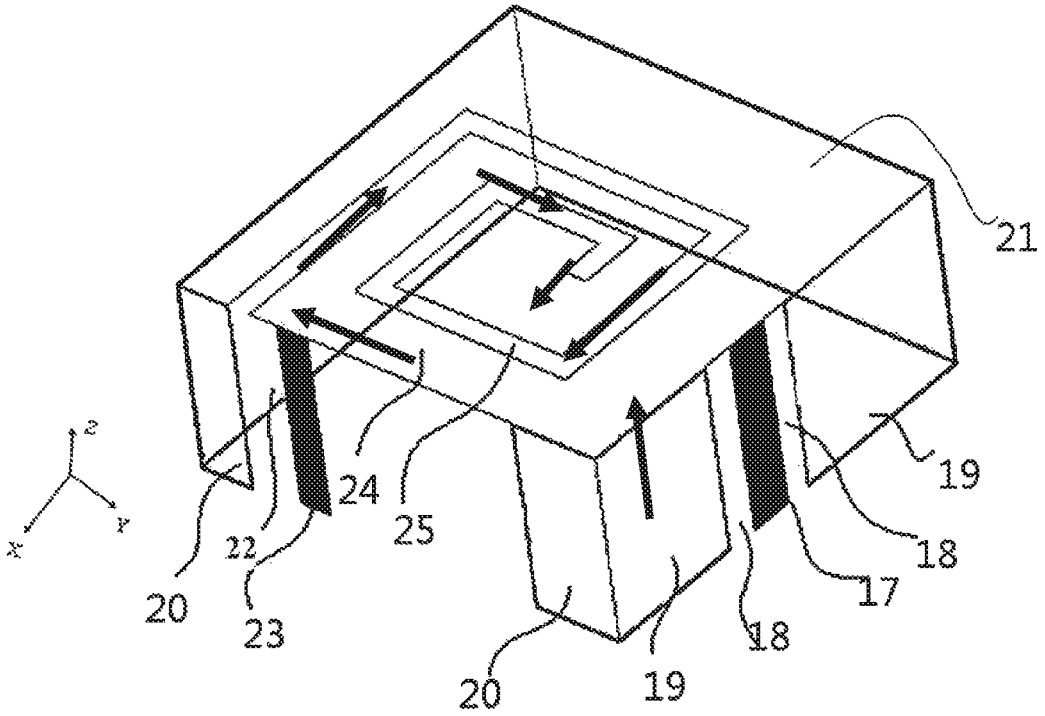
FIG. 8*a* is a schematic front view of a metal shielding cover slot antenna according to embodiment two.

FIG. 8*a* is a schematic front view of a metal shielding cover slot antenna 2 according to embodiment two, the metal shielding cover slot antenna 2 includes a metal shielding cover 24, and the metal shielding cover 24 includes an antenna feed terminal 17, an antenna support point 23, an antenna ground portion 22*a*, and a slot 25 in a top surface.

The arrows in FIG. 8*a* indicate the direction of an effective conductive path, that is, the effective conductive path starting from the antenna feed terminal 17 and extending along the peripheral structure of the slot 25 is formed.

Figure 8B:
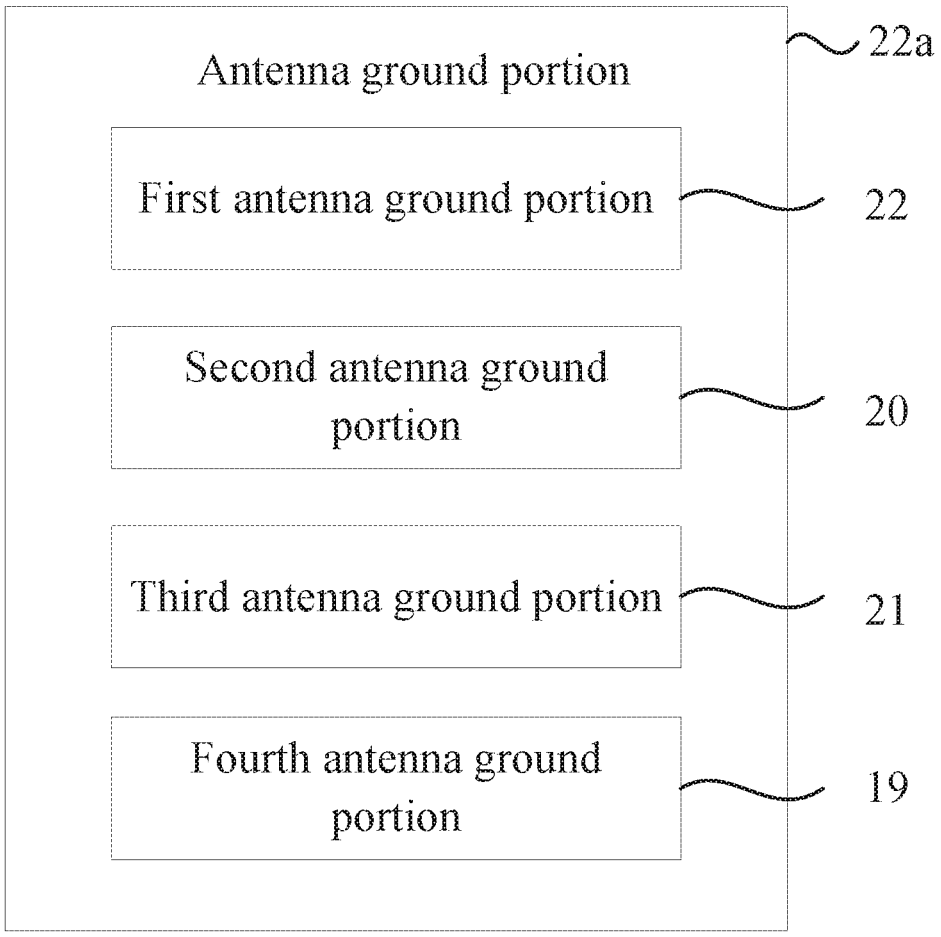
FIG. 8*b* is a schematic view of an antenna ground portion according to embodiment two.

The antenna ground portion 22*a* is formed in at least part of conductive surfaces of the metal shielding cover 24 excluding the top surface in which the slot 25 is positioned, the antenna feed terminal 17 and the antenna support point 23. In embodiment two, as shown in FIG. 8*b*, the antenna ground portion 22*a* includes a first surface of the antenna ground portion 22, a second surface of the antenna ground portion 20, a third surface of the antenna ground portion 21 and a fourth surface of the antenna ground portion 19. Each antenna ground portion is positioned in a respective one of the vertical conductive surfaces, and one end of each antenna ground portion is connected to the top surface and the other end of each antenna ground portion is welded to a corresponding ground pad on a printed circuit board 1.

In embodiment two, the antenna feed terminal 17 and the antenna support point 23 are formed through cuts in different conductive surfaces of the metal shielding cover 24.

The antenna support point 23 is disposed in a conductive surface in which the second surface of the antenna ground portion 20 is positioned, and two parts of the second surface of the antenna ground portion 20 are spaced apart in two sides of the antenna support point 23.

The antenna feed terminal 17 is disposed in another conductive surface of the metal shielding cover 24, for example, a conductive surface in which the fourth surface of the antenna ground portion 19 is positioned, and a cut gap 18 is formed though a cut in the conductive surface, so that a space is formed between the antenna feed terminal 17 and the fourth surface of the antenna ground portion 19.

Through adjustments to the width of the antenna feed terminal 17 and the size of the cut gap 18, the impedance and the bandwidth of the metal shielding cover slot antenna 2 can be adjusted and optimized. Therefore, the position of the antenna feed terminal may be flexibly set according to application scenarios.

Embodiment Three

Figure 11A:
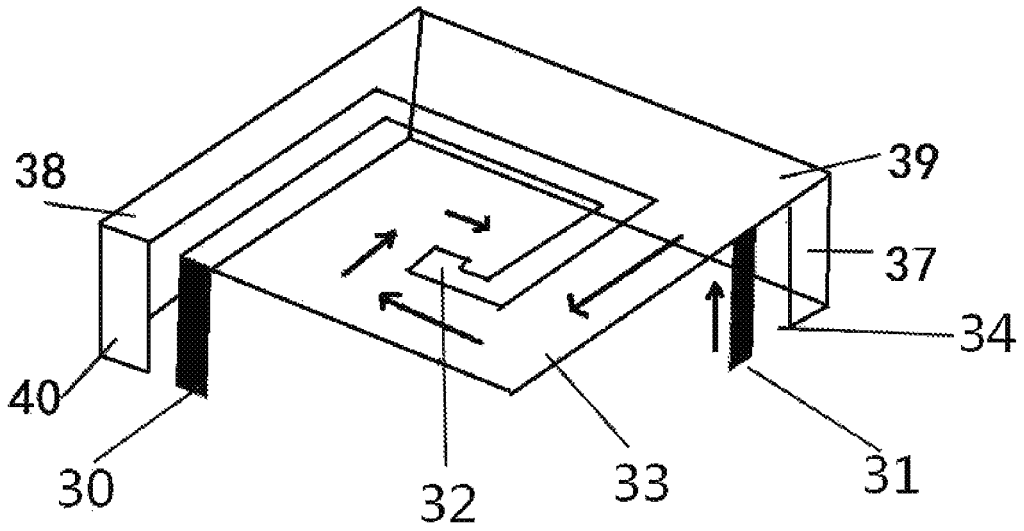
FIG. 11*a* is a schematic view of a metal shielding cover slot antenna according to embodiment three.

FIG. 11*a* is a schematic view of a metal shielding cover slot antenna 2 according to embodiment three. The metal shielding cover slot antenna 2 includes a metal shielding cover 33. The metal shielding cover 33 includes an antenna feed terminal 31, an antenna support point 30, an antenna ground portion 40*a*, and a slot 32 in a top surface.

The arrows in FIG. 11*a* indicate the direction of an effective conductive path, that is, the effective conductive path starting from the antenna feed terminal 31 and extending along the peripheral structure of the slot 32 is formed.

The antenna ground portion 40*a* is formed in at least part of conductive surfaces of the metal shielding cover 33 excluding the top surface in which the slot 32 is positioned, the antenna feed terminal 31 and the antenna support point 30.

Figure 11B:
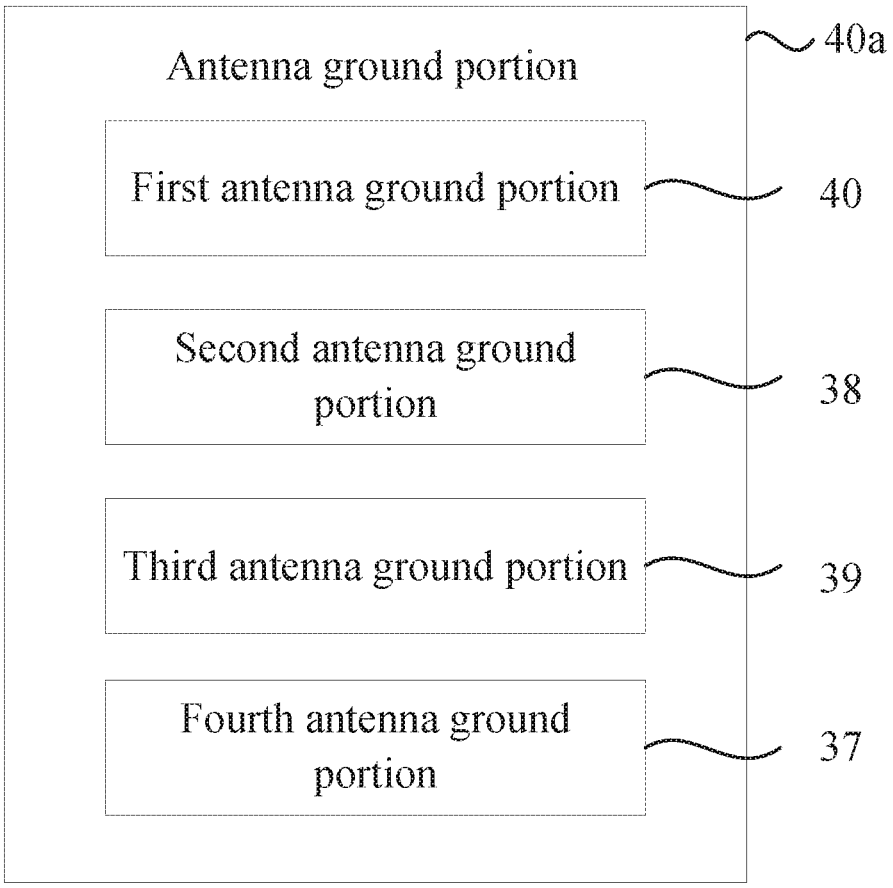
FIG. 11*b* is a schematic view of an antenna ground portion according to embodiment three.

In embodiment three, the antenna feed terminal 31 and the antenna support point 30 are formed through cuts in different conductive surfaces of the metal shielding cover 33. In one embodiment, as shown in FIG. 11*b*, the antenna ground portion 40*a* includes a first surface of the antenna ground portion 40, a second surface of the antenna ground portion 38, a third surface of the antenna ground portion 39 and a fourth surface of the antenna ground portion 37. Each antenna ground portion is positioned in a respective one of the four vertical conductive surfaces, and one end of each antenna ground portion is connected to the top surface and the other end of each antenna ground portion is welded to a corresponding ground pad on a printed circuit board 1.

In embodiment three, the antenna feed terminal 31 and the antenna support point 30 are formed through cuts in different conductive surfaces of the metal shielding cover 33.

The antenna feed terminal 31 is disposed in a conductive surface in which the fourth surface of the antenna ground portion 37 is positioned, and a cut gap 34 is formed though a cut in the conductive surface, so that a space is formed between the antenna feed terminal 31 and the fourth surface of the antenna ground portion 37.

The antenna support point 30 is disposed in another conductive surface of the metal shielding cover 33, for example, a conductive surface in which the first surface of the antenna ground portion 40 is positioned, so that a space is left between the antenna support point 30 and the first surface of the antenna ground portion 40. The biggest difference from embodiment two is that vertical conductive surfaces between the antenna support point 30 and the antenna feed terminal 31 are completely cut off in embodiment three.

Through adjustments to the width of the antenna feed terminal 31 and the size of the cut gap 34, the impedance and the bandwidth of the metal shielding cover slot antenna 2 can be adjusted and optimized. Therefore, the position of the antenna feed terminal may be flexibly set according to application scenarios.

Figure 12:
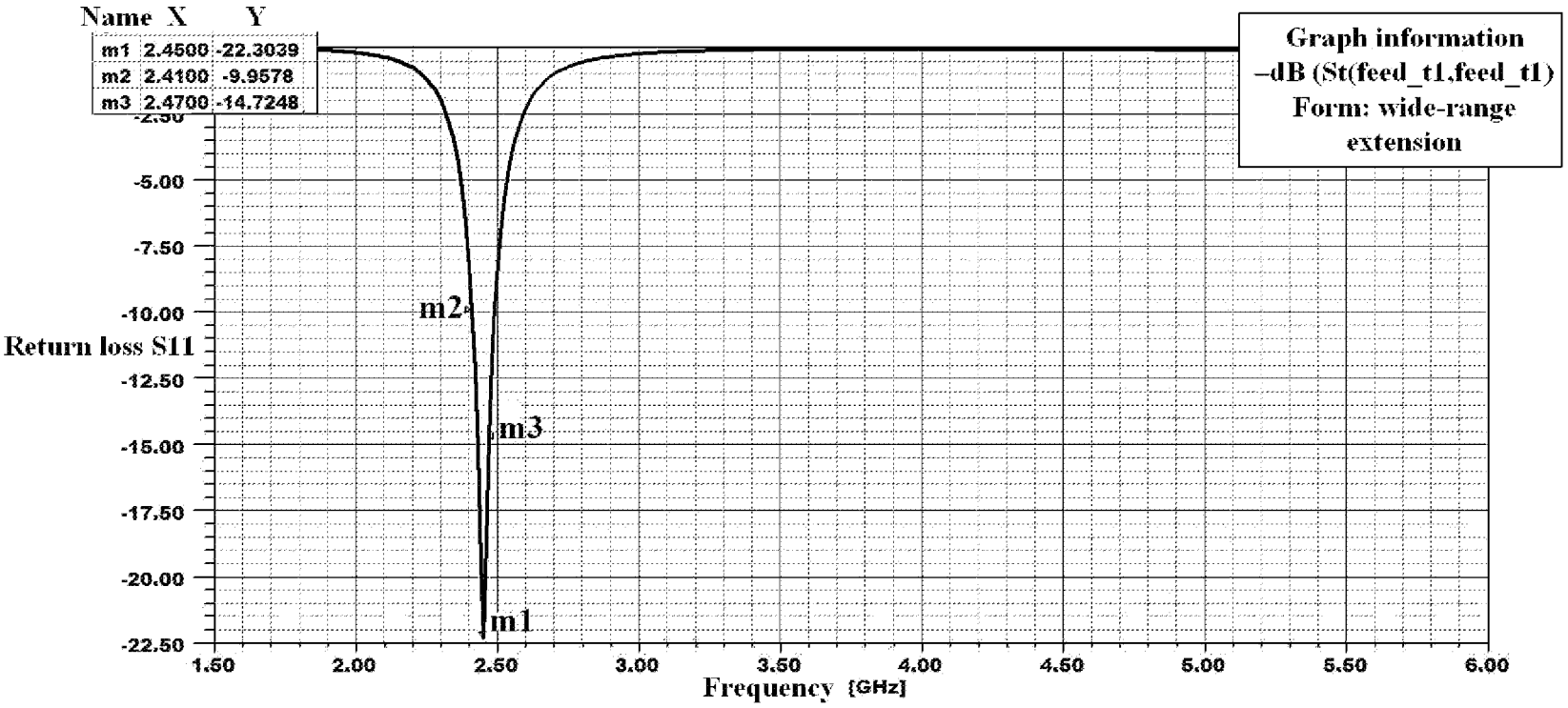
FIG. 12 is a schematic graph of preliminary data of an electromagnetic feature according to embodiment three.

FIG. 12 shows preliminary data of an electromagnetic feature in embodiment three, where the preliminary data is obtained by using electromagnetic simulation software. In FIG. 12, the abscissa represents the signal frequency and the ordinate represents the value of the return loss S11 obtained through simulation. The simulation model of this embodiment operates at 2.4 GHz, and the value of S11 is minimum when m1=2.45 GHz. In FIG. 12, listed frequency points m1, m2 and m3 of a wireless communication band at 2.4 GHz all satisfy basic signal transmission requirements.

Embodiment Four

Figure 9:
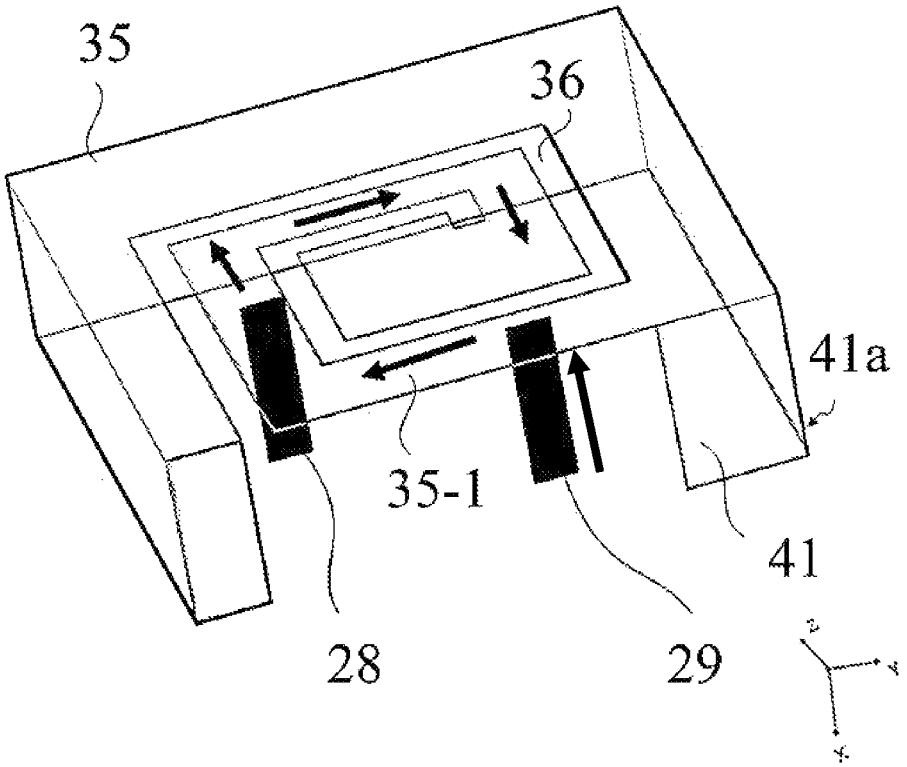
FIG. 9 is a schematic view of a metal shielding cover slot antenna according to embodiment four.

FIG. 9 is a schematic view of a metal shielding cover slot antenna 2 according to embodiment four. The metal shielding cover slot antenna 2 includes a metal shielding cover 35. The metal shielding cover 35 includes an antenna feed terminal 29, an antenna support point 28, an antenna ground portion 41*a*, and a slot 36 in a top surface.

The arrows in FIG. 9 indicate the direction of an effective conductive path, that is, the effective conductive path starts from the antenna feed terminal 29 and extends along the peripheral structure of the slot 36.

The antenna ground portion 41*a* is formed in at least part of the metal shielding cover 35 excluding the top surface in which the slot 36 is positioned.

In embodiment four, both the antenna feed terminal 29 and the antenna support point 28 are disposed in the inner space of the metal shielding cover 35, and both the antenna feed terminal 29 and the antenna support point 28 are not in any one conductive surface of the metal shielding cover 35. Moreover, the antenna feed terminal 29 and the antenna support point 28 are also in different planes than one or more conductive surfaces of the metal shielding cover 35.

The antenna feed terminal 29 and the antenna support point 28 may be formed from metal structures such as a probe, a cylinder, a square column, a regular sheet and the like, and then the antenna feed terminal 29 and the antenna support point 28 are connected to the inside of the metal shielding cover 35. Both one end of the antenna feed terminal 29 and one end of the antenna support point 28 are connected to the inner side of the top surface of the metal shielding cover 35, and the other end of the antenna feed terminal 29 and the other end of the antenna support point 28 are welded to the feed pad and the support point pad on a printed circuit board 1, respectively.

One end of each antenna ground portion 41*a* is connected to the top surface, and the other end of each antenna ground portion 41*a* is welded to a corresponding ground pad on the printed circuit board 1.

Through adjustments to the X-direction distance between the antenna feed terminal 29 and a straight line 35-1 at the edge of the opening of the metal shielding cover 35, and the adjustment to the Y-direction distance between the antenna feed terminal 29 and the second surface of the antenna ground portion 41, the impedance and the bandwidth of the antenna can be adjusted. Through adjustments to the width and length of the slot 36, the resonant frequency of the antenna can be adjusted.

Figure 10:
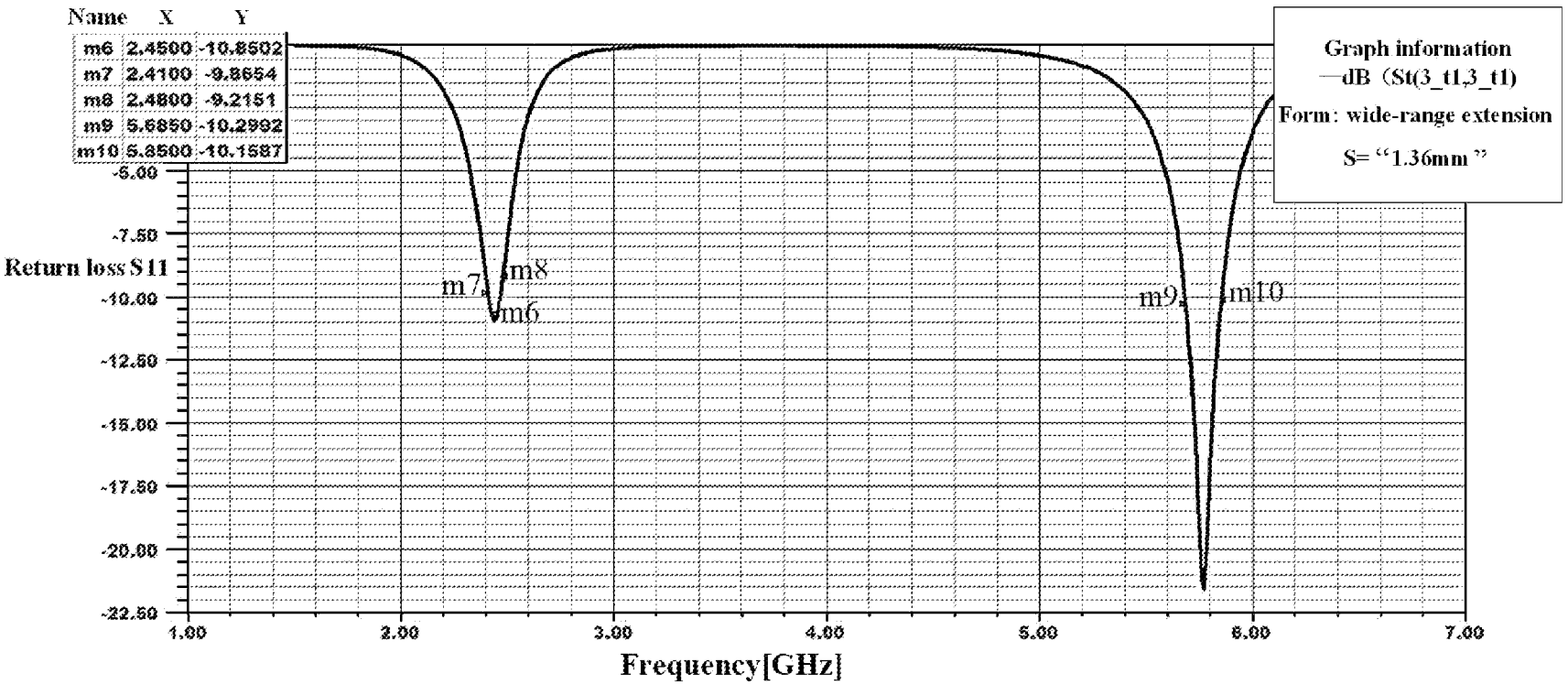
FIG. 10 is a schematic graph of preliminary data of an electromagnetic feature according to embodiment four.

FIG. 10 shows preliminary data of an electromagnetic feature in the embodiment four where the preliminary data may be given by using electromagnetic simulation software. In FIG. 10, the abscissa represents the signal frequency and the ordinate represents the value of the return loss S11 obtained through simulation. When S11 takes the minimum value, there are two valleys in FIG. 10. It follows that the metal shielding cover slot antenna 2 in the embodiment four shows a certain dual-frequency feature, and the two signal frequencies are in one-to-one correspondence with a Wi-Fi band and bluetooth communication band at 2.4 GHz, and a Wi-Fi band at 5 GHz. This phenomenon indicates that the metal shielding cover slot antenna 2 can be applied to some special scenarios. In FIG. 10, listed frequency points m6, m7, m8, m9 and m10 of a wireless communication band all satisfy basic signal transmission requirements.

Therefore, according to application scenarios and performance requirements, the antenna feed terminal and the antenna support point may be formed by a cut in the metal shielding cover, or the antenna feed terminal and the antenna support point may be generated from metal structures such as a probe, a cylinder, a square column, a regular sheet and the like, and then connected to the inside of the metal shielding cover.

What is claimed is:

1. A metal shielding cover slot antenna, comprising a metal shielding cover, wherein the metal shielding cover comprises a plurality of conductive surfaces, a slot, an antenna feed terminal and an antenna ground portion, wherein the slot is disposed in at least one of the plurality of conductive surfaces of the metal shielding cover; wherein the antenna ground portion is formed by a cut in at least one of the plurality of conductive surfaces; the antenna feed terminal is formed by a cut in at least one of the plurality of conductive surfaces; and a conductive path starting from the antenna feed terminal and extending along the slot is formed; and wherein the metal shielding cover slot antenna further comprises an antenna support point, and the antenna support point is disposed on a conductive surface in which the antenna ground portion is positioned, and a gap exists between each side of the antenna support point and each of two parts of the antenna ground portion;

wherein the antenna ground portion is configured to be connected to a ground plane; the antenna feed terminal is configured to be connected to a radio-frequency transceiver circuit which is connected to an antenna matching circuit through a first transmission wire; and the metal shielding cover is configured to at least overlap the radio-frequency transceiver circuit and the antenna matching circuit in a vertical direction.

2. The metal shielding cover slot antenna according to claim 1, wherein the metal shielding cover is a cube, a cylinder or an irregular three-dimensional structure.

3. The metal shielding cover slot antenna according to claim 1, wherein the conductive path is configured in one of following manners:

the conductive path is positioned in a two-dimensional conductive plane, and the two-dimensional conductive plane is any one of the plurality of conductive surfaces of the metal shielding cover or a plane in which any one of the plurality of conductive surfaces is positioned;

the conductive path is positioned in a three-dimensional conductive structure, and the three-dimensional conductive structure is formed by the plurality of conductive surfaces of the metal shielding cover; or the conductive path is positioned in a three-dimensional conductive structure, and the three-dimensional conductive structure is formed by a plane in which the antenna feed terminal is positioned and the plurality of conductive surfaces of the metal shielding cover, wherein the plane in which the antenna feed terminal is positioned is not any one of the plurality of conductive surfaces of the metal shielding cover.

4. The metal shielding cover slot antenna according to claim 1, wherein the antenna feed terminal and the antenna support point are positioned in different ones of the plurality of conductive surfaces of the metal shielding cover.

5. The metal shielding cover slot antenna according to claim 1, wherein the slot is formed in a top surface of the metal shielding cover and a peripheral shape of the slot comprises one of a strip, a rectangle, a circle, an ellipse or a polygon.

6. The metal shielding cover slot antenna according to claim 5, wherein the antenna feed terminal is formed by a cut in a first vertical conductive surface of the metal shielding cover vertical to the top surface; and the antenna support point is formed by a cut in a second vertical conductive surface of the metal shielding cover vertical to the top surface;

the first vertical conductive surface is different from the second vertical conductive surface.

7. The metal shielding cover slot antenna according to claim 1, wherein in condition that the antenna ground portion is formed by at least one of the plurality of conductive surfaces, the antenna ground portion is formed by all or part of conductive surfaces of the metal shielding cover excluding a conductive surface in which the slot is positioned, a position of the antenna feed terminal and a position of the antenna support point.

8. The metal shielding cover slot antenna according to claim 7, wherein the antenna feed terminal is spaced apart from the antenna ground portion through a gap; and the antenna feed terminal is spaced apart from the antenna support point through a conductive surface and a gap, or the antenna feed terminal is spaced apart from the antenna support point through a gap.

9. The metal shielding cover slot antenna according to claim 1, wherein the radio-frequency transceiver circuit is disposed on a printed circuit board; and the antenna ground portion is welded to the printed circuit board, or the metal shielding cover slot antenna is secured to the printed circuit board through a shielding cover clamp.

10. The metal shielding cover slot antenna according to claim 9, wherein the printed circuit board is provided with a feed pad, a support point pad and an antenna ground pad;

the antenna feed terminal is configured to be connected to the feed pad, and the radio-frequency transceiver circuit is configured to be connected to the feed pad through a transmission wire;

the antenna support point is configured to be connected to the support point pad; and the antenna ground portion is configured to be connected to the antenna ground pad.

11. An electronic device, comprising:

a wireless communication system, which comprises the metal shielding cover slot antenna according to claim 1; and a radio-frequency transceiver circuit communicatively connected to the metal shielding cover slot antenna;

wherein part of the metal shielding cover slot antenna is further connected to a ground plane disposed in the wireless communication system.

12. The electronic device according to claim 11, wherein the ground plane is provided with a ground reference portion, and the metal shielding cover slot antenna is at least partially connected to the ground reference portion.

13. The electronic device according to claim 11, wherein the wireless communication system further comprises a transmission wire, and the transmission wire is configured to transmit a signal.

14. The electronic device according to claim 13, wherein the antenna matching circuit is disposed between the radio-frequency transceiver circuit and the feed pad and is separately connected to the radio-frequency transceiver circuit and the feed pad through the transmission wire.

15. The electronic device according to claim 11, wherein the radio-frequency transceiver circuit comprises a radio-frequency transceiver operating in one or more radio-frequency communication bands, wherein the radio-frequency communication bands comprise a wireless fidelity (Wi-Fi) band at 2.4 GHz, a Wi-Fi band at 5 GHz or a bluetooth communication band at 2.4 GHz.

* * * * *